US005199641A

United States Patent [19]

Hohm et al.

[11] Patent Number: 5,199,641

[45] Date of Patent: Apr. 6, 1993

[54] FUEL INJECTION NOZZLE WITH CONTROLLABLE FUEL JET CHARACTERISTIC

[75] Inventors: Dietmar Hohm, Neufahrn; Peter Kleinschmidt, Munich; Hans Meixner, Haar; Dieter Stein, Holzkirchen, all of Fed. Rep. of Germany

[73] Assignee: Siemens Aktiengesellschaft, Munich

[21] Appl. No.: 671,881

[22] PCT Filed: Sep. 28, 1989

[86] PCT No.: PCT/DE89/00610

§ 371 Date: May 17, 1991

§ 102(e) Date: May 17, 1991

[87] PCT Pub. No.: WO90/03512

PCT Pub. Date: Apr. 5, 1990

[30] Foreign Application Priority Data

Sep. 29, 1988 [DE] Fed. Rep. of Germany ..... 3833093

[51] Int. Cl.[5] ..... B05B 3/14

[52] U.S. Cl. ..... 239/102.2; 239/456; 239/585.1; 251/129.18; 123/494; 123/498

[58] Field of Search ..... 239/579, 585, 102.2, 239/455, 456, 102.1; 123/494, 498, 179.7; 251/129.05, 129.06, 129.09, 129.18

[56] References Cited

U.S. PATENT DOCUMENTS 4,211,199 7/1980 Thatcher .
4,431,136 2/1984 Janner et al. ..... 239/102.2
4,669,660 6/1987 Weber et al. ..... 251/129.05
4,684,104 8/1987 Micard ..... 239/102.2
4,725,002 2/1988 Trachte ..... 239/102.2
4,750,706 6/1988 Schlagmüller ..... 239/102.2
4,798,188 1/1989 Ito et al. ..... 239/585.4
4,972,996 11/1990 Cerny ..... 239/585.4

FOREIGN PATENT DOCUMENTS 36617 9/1981 European Pat. Off. .
2123635 11/1971 Fed. Rep. of Germany .
2150978 7/1985 United Kingdom ..... 239/585

OTHER PUBLICATIONS

Patent Abstract of Japan, vol. 9, No. 142 (M-388) (1865) Jun. 18, 1985, & JP-A-60 22066 (Hitachi Kinzoku K.K.) 04.

Patent Abstracts of Japan, vol. 7, No. 283 (M-263) (1428) Dec. 16, 1983, & JP-A-58 158366 (Hitachi Seisakusho K.K.) 20.

*Primary Examiner*—Andres Kashnikow
*Assistant Examiner*—Christopher G. Trainor
*Attorney, Agent, or Firm*—Hill, Steadman & Simpson

[57] ABSTRACT

A fuel injection nozzle for a combustion engine not only has a valve for alternately opening and closing the nozzle, but also has a part which undergoes alternating stroke movement, either longitudinally or transversely. The alternating stroke movement changes the opening angle of the nozzle opening. The alternating stroke movement is in a frequency range of approximately 5 to 20 kiloHertz.

11 Claims, 6 Drawing Sheets

FUEL INJECTION NOZZLE WITH CONTROLLABLE FUEL JET CHARACTERISTIC

BACKGROUND OF THE INVENTION

1. Field of the Invention

The present invention relates to a rue nozzle for a combustion engine, and preferably a low pressure fuel injection nozzle.

The injection under pressure of the fuel necessary for operation at a particular predetermined point of the combustion engine has been known for a long time, initially for diesel engines and then for Otto engines. This can be fuel injection into a space downstream of the inlet valve. For Otto engines, injection onto the inlet valve or into the intake pipe upstream of the inlet valve is also customary.

There are attempts being made to configure and operate an injection nozzle in such a way that it produces a finer aerosol than is otherwise customary and/or possible with an injection nozzle. In such injection nozzles, as is known from EP-A-36 617, ultrasonic vibration is additionally provided, as has already been known for a long time for ultrasonic liquid atomizers. For liquid atomization, the ultrasonic frequency to be employed necessarily lies in the range above 100 kHz. The precise frequency and the design of a respectively provided nozzle part vibrating at ultrasonic frequency are mutually dependent. The injection nozzle per se here produces a fuel jet which corresponds in shape to the structural configuration and the liquid constituents of which are then atomized by that part of the whole nozzle which is vibrating at ultrasonic frequency to form a flowing mist of droplets consisting of fine aerosol droplets. Much the same is evident to the person skilled in the art from JP-A-60 22 066.

The present invention is concerned with a development leading in another direction, namely with the provision of measures for the appropriate selection of the shape of the fuel jet.

All known fuel injection nozzles have a characteristic fuel jet shape predetermined by their construction. As is known, the shape of the fuel jet is important for the formation of the air/fuel mixture, not only with respect to minimum specific fuel consumption but also with respect to environmental pollution by unwanted exhaust-gas components which are formed, and important for the smoothness of running of the engine. A distinction is drawn, for example, between a fuel injection nozzle which produces a concentrated jet and a nozzle which delivers a conical jet. Both shapes of jet have size distributions of the droplets of fuel sprayed from the nozzle which are characteristic of them and, moreover, among other things also different.

Different shapes of the fuel jet are optimal in each case depending on parameters of a particular combustion engine and the features of its construction and the particular load condition.

SUMMARY OF THE INVENTION

It is the object of the present invention to indicate measures by which, in addition, it is possible to achieve in each case at least substantially optimum mixture formation with the selected injection nozzle for different operating conditions as well.

This object is achieved a fuel injection nozzle having a nozzle bore arranged in a nozzle part, a nozzle needle, a drive having an electrical input variable by means of which the nozzle needle can be moved into a closing position, in which it closes the nozzle bore and, into an open position, in which it frees the nozzle bore, and means by which, during the open position of the nozzle needle, an alternating stroke movement can be imparted to at least a part of the injection nozzle which is situated in the region of the formation of the injection jet, these means being excitable by an electrical input variable and being designed structurally in such a way that the period for the alternation of the stroke movement is many times smaller than the predetermined minimum opening time of the injection nozzle, wherein the means for exciting the alternating stroke movement of the part, of which there is at least one, of the injection nozzle impart stroke movements with a period which corresponds to an excitation frequency of between 5 kHz and 20 kHz, and the opening angle of the injection jet of the injection nozzle can be altered by control of the electrical input variable of the means for the alternating stroke movement. Further configurations and further developments of the invention include providing the injection nozzle with an alternating voltage in addition to the electrical actuating voltage to be applied for opening the nozzle to excite the alternating stroke movement preferably forms a resonant system. The means for exciting the alternating stroke movement are designed in such a way that the nozzle needle executes these alternating stroke movements, in one embodiment. In another embodiment, the means for exciting the alternating stroke movement are designed in such a way that a portion of the nozzle bore executes this alternating stroke movement.

Two different alternate stroke movements are provided, namely either a longitudinal alternating stroke movement or a transverse alternating stroke movement.

The means for exciting the alternating stroke movement comprises a piezoelectric excitation device. Alternately, the means for exciting the alternating stroke movement comprises an electrodynamic device with a homogeneous magnetic field or comprises a magnetostrictive device. Another possibility is that the alternating stroke movement comprises an electromagnetic device.

The present invention is based on the idea of providing technical means on or for a fuel injection nozzle, by which the characteristic shape of the fuel jet of this one nozzle can be altered in electrically controllable fashion during operation. According to the invention, the shape of the jet of the nozzle is controlled by these means in such a way that different opening angles of the injected jet, from the (thin) concentrated jet to a conical jet with an opening angle of, for example, 70° or even greater, can be achieved.

With an injection nozzle according to the invention, the shape of the jet can be altered in controllable fashion and adapted in optimum fashion during operation. A controllable alteration of the distribution of the droplet size is furthermore carried out during this process. The invention relates in particular to low-pressure injection at about 1 to 10 bar.

In the vast majority of cases, fuel injection nozzles also operate as injection valves. The driving of the valves can here be based on the action of the liquid pressure exerted by the fuel to be injected. However, injection nozzles are increasingly being provided with electromechanical devices for opening and closing their valve portion. Electromagnetic designs predominantly been provided for this purpose. There are also already fuel injection nozzles having a valve arrangement with a piezoelectric drive.

While remaining within boundary conditions recognized to be particularly meaningful, a solution is achieved with the present invention which makes it possible to set varied shapes of jet with a single injection nozzle which are to the greatest possible extent optimally matched to the various types of operating conditions of a reciprocating combustion engine. These various operating conditions are, in particular, on the one hand, the cold-start phase and, on the other hand, continuous operation of the engine with the engine warmed up to a steady temperature. It would be conceivable, particularly for the two abovementioned operating states, to provide two different injection nozzles, each of which could be optimized to its allocated operating phase. However, the intention is to provide only one injection nozzle. As regards the cold-start phase, the boundary condition which must be fulfilled in particular is that the fuel injected in each case during the intake stroke of the engine enters the cylinder as a cone-shaped jet in such a highly atomized form that the correct mixing of fuel with air and hence fuel combustion does in fact actually occur.

In the continuous operating phase, i.e. at the operating temperature of all the engine components, a hot inlet valve, in particular, is present and this is highly suitable for the fine distribution or vaporization of the fuel. It is accordingly also perfectly customary to direct the fuel to be injected in a substantially concentrated or only slightly spread injection jet at the hot valve head and allow it to strike the latter.

In connection with the invention, it has been observed that it is not always necessarily advantageous in the continuous operating phase to provide substantial atomization of the fuel to be injected, in particular atomization that is produced by ultrasound, so that the atomization starts already directly from the injection nozzle. It has namely been observed that, despite the high operating temperature of the engine block, disadvantageous states can and do occur when the fuel is finely divided or atomized right from the nozzle. On the one hand, it is still possible that fuel droplets will be deposited in the intake pipe, which has after all heated up only to a limited extent, and these then enter the cylinder only after a delay, at the wrong time, due to re-evaporation. Air-column vibrations in the intake pipe can likewise lead to states such that fuel atomized directly out of the nozzle does not enter the respective cylinder at the desired time. In either case, this is associated with undesired shifts in the fuel/air ratio, which should be metered into the cylinder as precisely as possible, as intended.

According to the invention, the single fuel injection nozzle per cylinder is designed in such a way that it can bring about a plurality of different forms of "jet formation", which forms can be selected in a controllable fashion. Due to this controllability, it is possible with a fuel injection nozzle according to the invention, in particular for continuous operation, to produce a concentrated jet whose cross-section of impact on the valve is limited to a predeterminable portion of the surface area of the valve head. It is thereby achieved that the fuel passes with as little loss as possible onto the valve and on immediately and without a diversion into the cylinder. The optimum fuel/air ratio metered into the cylinder can thus be maintained with certainty. Due to the evaporation of the fuel on the hot valve head, it is ensured that optimally finely diffused fuel/air mixture is available for combustion in the cylinder.

In the cold-start phase, the injection nozzle according to the invention is controlled in such a way that very fine dispersion of the fuel occurs. With the injection nozzle according to the invention, the injection jet produced for this operating phase of the engine has a certain expansion shaped like a conical jet. Such a conical jet has the property that—only at a certain distance from its nozzle opening—the liquid first of all dissociates in the jet and that only then, but sufficiently early for the combustion process, is a significant portion of the injection quantity present in finely divided droplet form. The above-mentioned distance which arises here is important in this arrangement since it is thereby possible to ensure that this fine division of the fuel in the conical jet is present only just before or even at the inlet valve and precipitation of droplets, for example on the wall of the intake pipe (i.e. in the region between the nozzle opening and the inlet valve), is prevented. This advantage arises particularly in the case of those known injection nozzles which have integrated ultrasonic liquid atomization. Account should of course be taken of the fact that the fuel injection nozzle cannot be arranged in arbitrary proximity to the inlet valve.

With the invention, it is in addition possible with only modestly higher expenditure to achieve a substantially more advantageous result for the cold-start phase than a per se known fuel injection nozzle designed for ultrasonic fuel atomization. It has namely been established that the ultrasonic energy which would be required for truly quantitative fuel atomization by ultrasound in the case of intermittent, cylinder-selective injection would be of a magnitude which in practice cannot possibly be provided, at least taking into account the structural size of an injection nozzle.

An injection nozzle according to the invention is designed in such a way that it has a rapidly responding and rapidly operating drive for opening and closing the nozzle aperture. In individual cases, it may be advantageous, especially for optimum fulfillment of the conditions in the idle operating mode, if the injection nozzle according to the invention is one which has a proportional drive or proportional adjustability of the nozzle aperture. It is namely thereby possible easily and in a defined manner to set those intermediate values of the degree of opening of the injection nozzle with which an exact metering of the very small injection quantities per injection process, which are precisely those under consideration in idle operation, can be maintained.

As a practical application, the operating repetition frequency, e.g. for a four-cylinder or six-cylinder engine, and hence the repetition frequency for the opening ($t_1$) and closing ($t_2$) of the valve portion of the injection nozzle is about 5 Hz to 50 Hz. Correspondingly steep leading edges and trailing edges of the opening and closing of an injection nozzle according to the invention at a frequency of considerably above 1 kHz (with a corresponding interval T) represent the upper limit of the Fourier spectrum of the pulse of opening and closing.

The requirements of an injection nozzle according to the invention may be indicated by the following illustrative operating values for a medium-size passenger car:

The fuel throughput in the case of a continuously open injection nozzle (in the intake phase) is about 6 g/s per cylinder This corresponds to virtually full-load operation.

The idling throughput of such an engine is about 0.4 mg/s per cylinder. As is evident, this gives a dynamic range to be coped with of four orders of magnitude.

Particular embodiments of an injection nozzle according to the invention are distinguished by the fact that the valve needle serving essentially for the opening and closing of the injection nozzle (which is also designed as a valve), and/or the aperture cross-section of the nozzle are to have stroke movements imparted to them. As a function of the electrically adjustable stroke period, it is possible, with different opening angles, to vary the cross-section of the jet, i.e. the shape of the jet, e.g. from a concentrated jet to a conical jet. The attached FIG. 1 serves to illustrate this point, showing a time/excitation or opening diagram of an injection nozzle according to the invention. Due to the above-mentioned rapid response of its parts, the injection nozzle according to the invention is capable, particularly in the case of a proportional drive, of periodically following with its stroke movements the mechanical movements of the electrical excitation. The modulation shown in FIG. 1 relates to an embodiment in accordance with FIG. 2 or 3. The excitation frequencies for this stroke movement are optimally in the range from 5 kHz to 20 kHz, i.e. well below ultrasonic atomizer frequencies This rating applies both to injection nozzles or valves in low-pressure systems (about 3 bar) and to those of customary nozzle diameter (0.3 to 1 mm).

BRIEF DESCRIPTION OF THE DRAWINGS n FIG. 1 is shown an excitation diagram over time for a fuel injection nozzle according to the principles of the present invention.

DETAILED DESCRIPTION OF THE PREFERRED EMBODIMENTS

Figure 1:
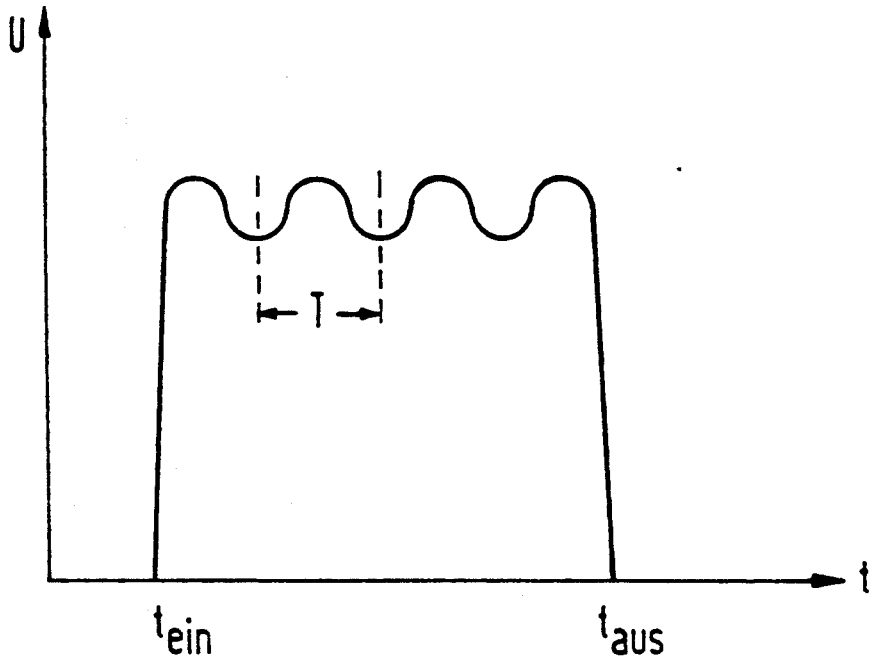
Figure 2:
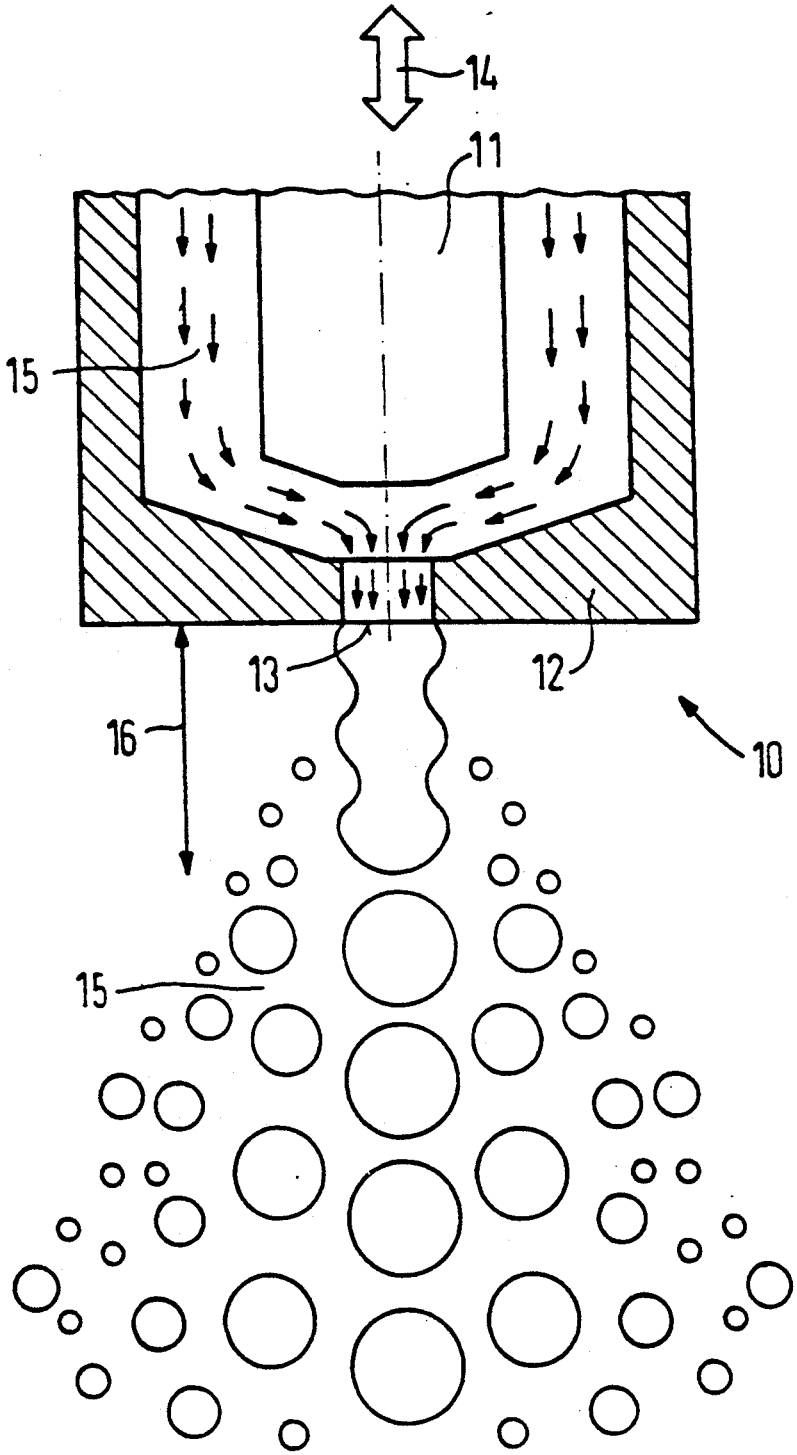
FIG. 2 shows a basic structure of an injection nozzle 10 according to the invention, with a superimposed, rapidly alternating stroke movement of the nozzle needle.

In FIG. 2, 11 denotes the nozzle needle, which also acts as a valve needle. It is situated in that part 12 of the nozzle which possesses the illustrated bore as a nozzle aperture 13. If the injection nozzle is closed, the front end of the nozzle needle 11 seals the nozzle aperture 13. 14 indicates the controllable mobility of the nozzle needle 11. In the opened state of the injection nozzle, fuel, indicated by 15, flows along the nozzle needle 11 and within nozzle part 12 to the nozzle aperture 13 and forms an injection jet having the illustrated characteristic 15 and a conical shape. This shape 15 of the jet results from the fact that, superimposed on the nozzle needle 11 in the opening position, is the additional alternating stroke movement indicated by 14. 16 indicates the distance, already discussed above (and here shown somewhat foreshortened), within which, starting from the nozzle aperture 13, the ejected conical jet does not yet exhibit any significant division into droplets. Moreover, this shows clearly the difference in relation to ultrasonic fuel atomization, where the droplets arise at the vibrating part and emanate from the latter.

Figure 3:
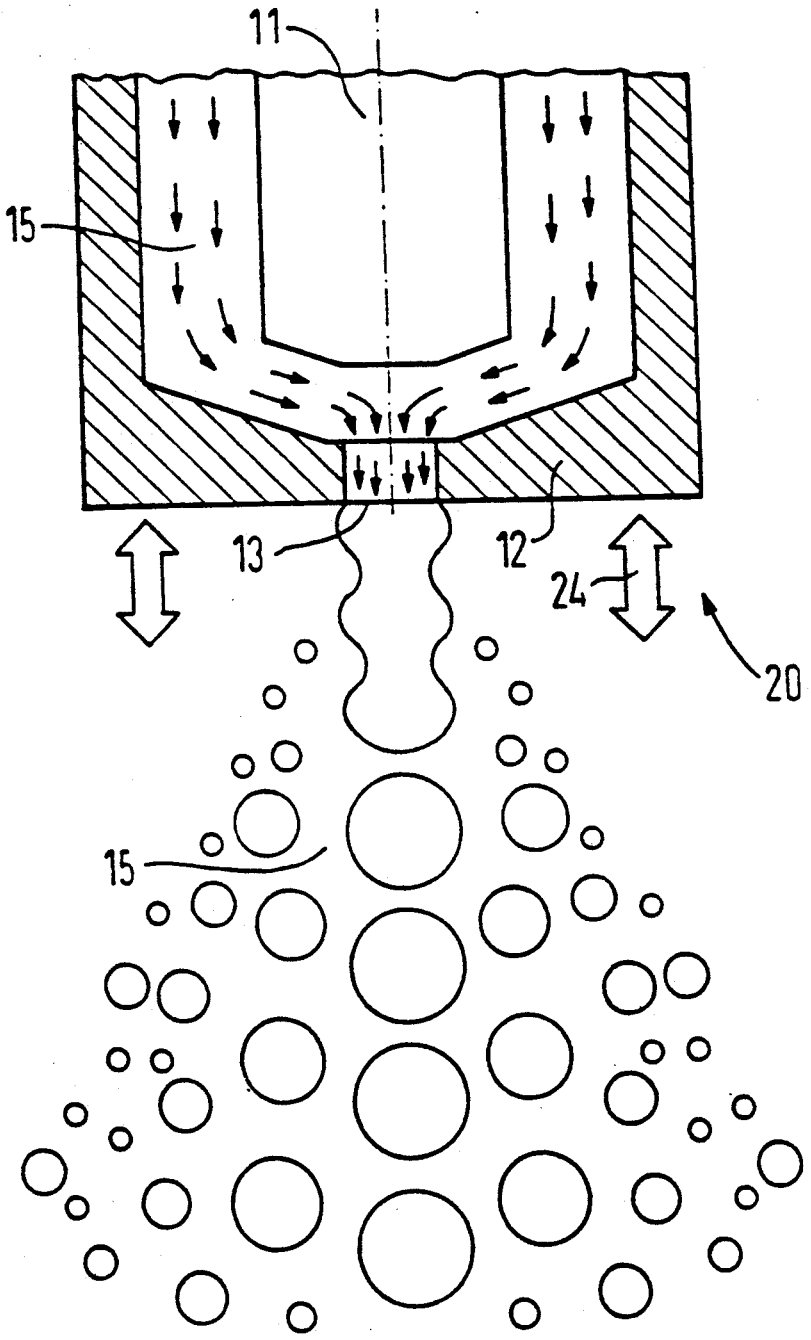
FIG. 3 shows a corresponding embodiment with stroke movement of the (valve) seat of the injection nozzle 20.

With regard to FIG. 3, reference can largely be made to the details described in relation to FIG. 2. Reference numerals already described in relation to FIG. 2 have the same or at least analogous significance in FIG. 3. For the embodiment according to FIG. 3, alternating stroke movement is provided for the nozzle part 12 having the nozzle aperture 13. An embodiment according to FIG. 3 results in a shape of jet which corresponds essentially to that of the embodiment according to FIG. 2.

Figure 5:
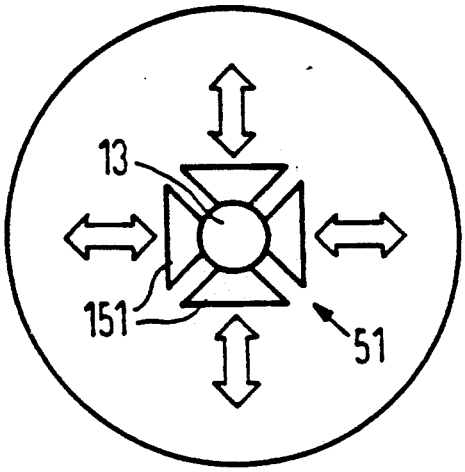
FIGS. 4 and 5 show an embodiment 40 having a device for modulating the effective injection aperture, in side view and front view.
Figure 4:
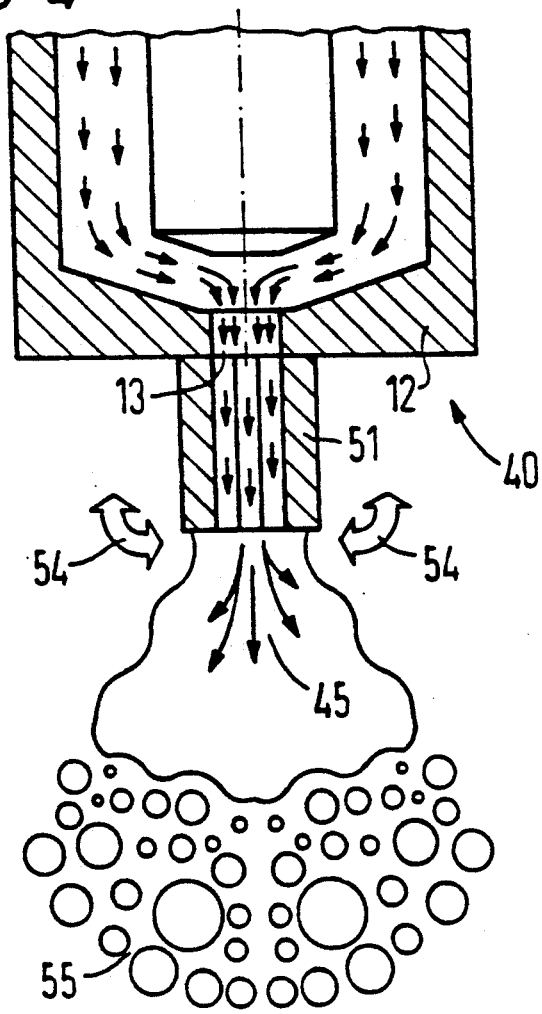

Instead of the longitudinal stroke movement of the foregoing embodiments, a transverse stroke movement is possible, wherein FIGS. 4 and 5 show a supplementary device 51 attached to the nozzle part 12 in the region of the nozzle aperture 13. FIG. 5 shows an end view appertaining to FIG. 4, i.e. a view towards the ejected jet. This additional device 51 attached to the actual injection nozzle of FIGS. 4 and 5 comprises, for example, four rod-shaped extensions 151, each of which is capable of performing stroke movements. These stroke movements are indicated by the individual arrows 54. These stroke movements 54 are bending movements of the parts 151. The stroke movements 54 of the extensions 151 are caused when the extensions are struck by the oscillating fluid being ejected by the nozzle 13. The fluid is, in turn, caused to oscillate by one of the herein described means, such as the above described alternating stroke movement 14. These parts 151 form longitudinal guides for the fuel jet 45 emerging from the nozzle aperture 13. The alternating stroke movements 54 transverse to the spray direction of said fuel jet 45 lead to a shaping of jet as represented by 55.

Figure 6:
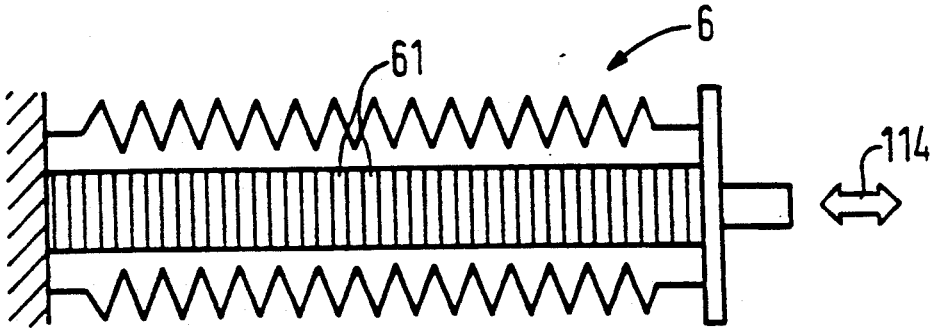
FIG. 6 shows a piezoceramic drive device

The alternating stroke movement, such as the longitudinal movements described in conjunction with FIGS. 2 and 3, are performed, for example, by a drive element 6 according to FIG. 6 which comprises a stack of piezoelectrically excitable disks 61. These disks are provided with flat electrodes (not shown). Such stacks are in principle known per se and, in the present case too, are supplied with a controlled electric voltage. They are preferably supplied with an alternating voltage, preferably with an alternating voltage of a frequency which leads to sympathetic vibration movements of the stroke movement 114 of the stack or drive 6.

Figure 7:
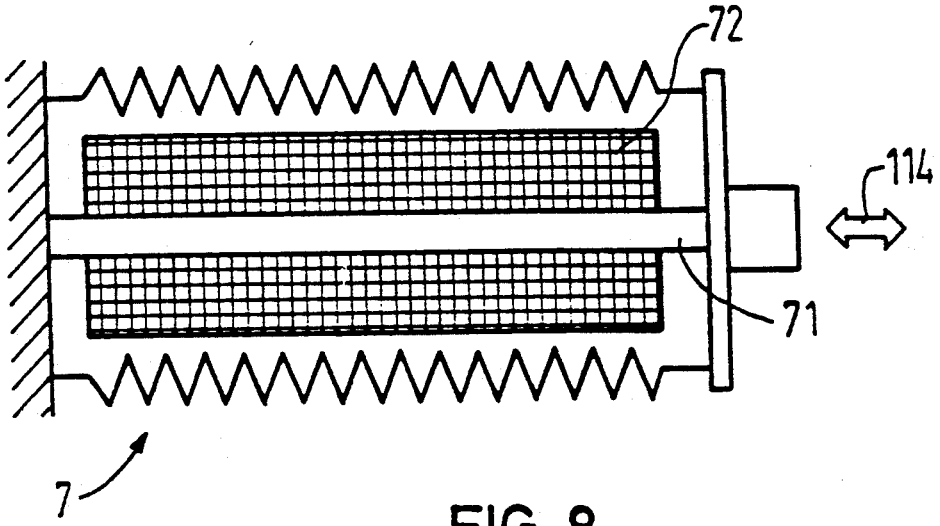
FIG. 7 shows a magnetostrictive drive device.

FIG. 7 shows a magnetostrictive embodiment 7 of an alternate embodiment of a drive for performing the alternating stroke movements according to the invention. 71 denotes a rod which can be excited into magnetostriction movements and is situated inside a magnetic field coil 72. This magnetic field coil 72 is supplied with an electric voltage, again preferably of a frequency which leads to resonance of the rod 71 with a natural vibration, leading to a correspondingly large stroke amplitude of the stroke movement 114.

Figure 8:
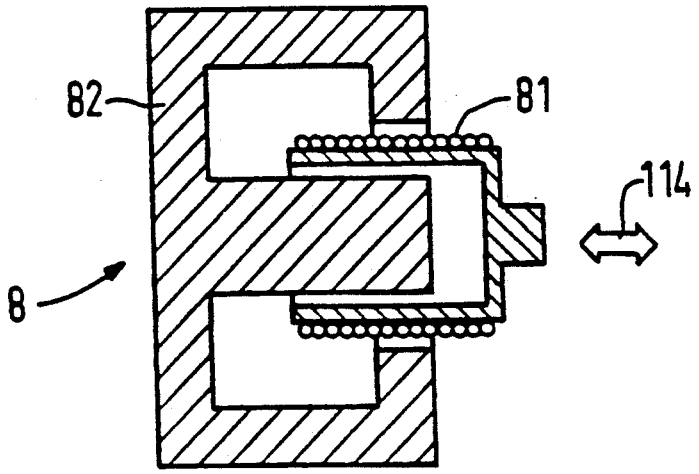
FIG. 8 shows an electrodynamic drive device for an injection nozzle according to the invention.

In FIG. 8, a drive 8 with a moving coil 81 and a pot magnet 82, as known in principle from loudspeakers, is depicted. Given appropriate electric alternating excitation, such a device leads to mechanical stroke movements 114 for driving the alternating stroke movements shown in FIGS. 2 and 3. Here, too, resonance excitation can be effected.

Figure 9:
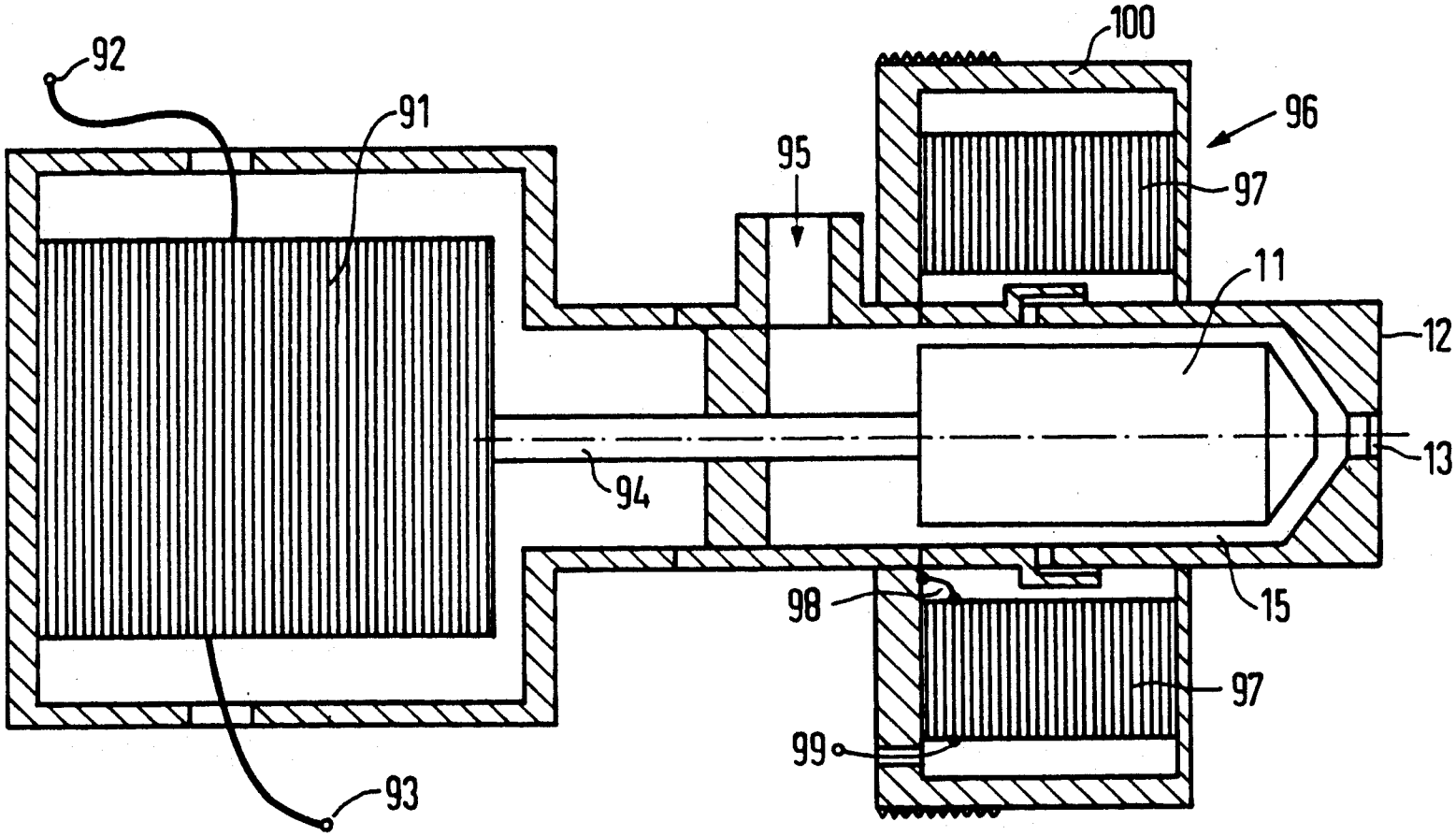
FIG. 9 shows an injection nozzle according to the invention as a complete embodiment.

FIG. 9 shows an example of an injection nozzle according to the invention. Details given in relation to the figures described above have the same significance in FIG. 9.

91 denotes an actuator, for example a stack of piezoelectric plates. Due to application of an electric voltage between the connections 92 and 93, this actuator changes in length and thus drives the plunger 94 and the nozzle needle 11 connected to the plunger 94. The actuator 91 is used for opening and closing the valve by moving the valve needle 11. 95 denotes the fuel feed port of the injection nozzle.

96 is the overall reference for the drive device for the alternating stroke movement to be executed according to the invention. In this example, this drive device comprises a plurality of stacks 97 with the electrical connecting leads 98 and 99. The alternating drive voltage for this stroke movement is to be applied between the connections 98 and 99. The (alternating) change in the length of the plate stack 97 due to the piezoelectric effect results in a corresponding change in the length of the housing 100 of the drive device 96. Since, as can be seen from the figure, the external housing 12 of the injection nozzle is divided (in sealed fashion), this nozzle part 12 executes the alternating stroke movements according to the invention, relative to the nozzle needle that is held stationary in the opened state in this example, due to the operation of the drive 96. This corresponds to the variant embodiment of the invention already described above in connection with FIG. 3.

Although other modifications and changes may be suggested by those skilled in the art, it is the intention of the inventors to embody within the patent warranted hereon all changes and modifications as reasonably and properly come within the scope of their contribution to the art.

I claim:

1. A fuel injection nozzle for combustion engines, comprising:

a nozzle bore arranged in a nozzle part, a nozzle needle within the nozzle part, a drive connected to the nozzle needle, said drive having an electrical input for receiving an electrical input variable to cause the nozzle needle to be moved into a closing position, in which said nozzle needle closes the nozzle bore, and alternately into an open position, in which said nozzle needle frees the nozzle bore, and means for imparting, during the open position of the nozzle needle, an alternating stroke movement to at least one of said nozzle part and said nozzle needle which is situated in a region of formation of an injection jet, said means for imparting being excitable by a further electrical input variable and being designed structurally in such a way that a period for the alternating stroke movement is many times smaller than a predetermined minimum opening time of the injection nozzle, said means for imparting imparts the alternating stroke movements with a period which corresponds to an excitation frequency of between 5 kHz and 20 kHz, and said means for imparting alters an opening angle of the injection jet of the injection nozzle under control of the further electrical input variable.

2. An injection nozzle as claimed in claim 1, wherein, to excite the alternating stroke movement, said means for imparting is said drive and receives an alternating voltage as said further electrical input variable in addition to the electrical input variable for opening the nozzle.

3. An injection nozzle as claimed in claim 1, wherein the means for imparting the alternating stroke movement forms a resonant system.

4. An injection nozzle as claimed in claim 1, wherein the means for imparting the alternating stroke movement moves the nozzle needle, and wherein the nozzle part is stationary during the alternating stroke movement.

5. An injection nozzle as claimed in claim 1, wherein the means for imparting the alternating stroke movement moves the nozzle part in which the nozzle bore is arranged, and wherein said nozzle needle is stationary during the alternating stroke movement.

6. An injection nozzle as claimed in claim 1, wherein said means for imparting imparts longitudinal alternating stroke movements.

7. An injection nozzle as claimed in claim 1, wherein said means for imparting is a first means for imparting, and further comprising:

second means for imparting alternating stroke movements, said second means for imparting imparts transverse alternating stroke movements, said second means for imparting including extensions on said nozzle part about the nozzle bore, said extensions being subject to bending during ejection of liquid from the nozzle bore.

8. An injection nozzle as claimed in claim 1, wherein the means for imparting the alternating stroke movement comprises a piezoelectric excitation device.

9. An injection nozzle as claimed in claim 1, wherein the means for imparting the alternating stroke movement comprises an electrodynamic device with a homogeneous magnetic field.

10. An injection nozzle as claimed in claim 1, wherein said means for imparting the alternating stroke movement comprises a magnetostrictive device.

11. An injection nozzle as claimed in claim 1, wherein said means for imparting the alternating stroke movement comprises an electromagnetic device.

* * * * *